United States Patent [19]

Hurtt

[11] 4,097,951

[45] Jul. 4, 1978

[54] SPREADER HAVING INTEGRALLY MOLDED DEFORMABLE HANDLE AND BENDABLE BLADE

[76] Inventor: Jesse J. Hurtt, 6059 Short Leaf Dr., Forest Park, Ga. 30050

[21] Appl. No.: 781,746

[22] Filed: Mar. 28, 1977

[51] Int. Cl.[2] ..... B05C 17/10

[52] U.S. Cl. ..... 15/104 S; 15/144 R; 15/245; 425/12

[58] Field of Search ..... 15/104 S, 245, 250.36; 17/19, 66; 401/183, 184, 186, 9; 425/87, 12

[56] References Cited

U.S. PATENT DOCUMENTS

| | | | |
|---|---|---|---|
| 2,083,551 | 6/1937 | Balinger | 401/186 |
| 2,926,375 | 3/1960 | Flynn | 15/250.36 |
| 3,676,888 | 7/1972 | Akers | 15/245 |
| 3,785,002 | 1/1974 | Quinlan | 15/250.36 |

FOREIGN PATENT DOCUMENTS

| | | | |
|---|---|---|---|
| 583,367 | 9/1933 | Fed. Rep. of Germany | 15/250.41 |
| 1,952,855 | 4/1971 | Fed. Rep. of Germany | 15/250.36 |

*Primary Examiner*—Daniel Blum
*Attorney, Agent, or Firm*—Patrick F. Henry

[57] ABSTRACT

Especially effective for use with fast hardening metal fillers comprising resin and catalyst the present spreader, which may be integrally molded in a continuous combination of injection and blow molding comprises an elongated handle which is hollow and deformable and a blade which is solid whereby sculpturing and contouring may be achieved more readily through hand manipulation and the spreader is more easily cleaned.

7 Claims, 6 Drawing Figures

SPREADER HAVING INTEGRALLY MOLDED DEFORMABLE HANDLE AND BENDABLE BLADE

BACKGROUND OF THE INVENTION

1. FIELD OF THE INVENTION

Tools and implements such as putty knives, spreaders and the like.

2. DESCRIPTION OF THE PRIOR ART

The prior art includes many types of spreaders and squeegee devices many of which are intended for use in cleaning liquids from windows and provide rigid handles with flexible blades. Such devices are not suited for use in applying heavier substances, adhesives, mastics, quickdrying body solders and the like because of the rigidity of the handles and the flexibility of the blades. For example, a rubber squeegee with a rigid handle and a flexible rubber or plastic blade is virtually useless for spreading quick-drying body solder, which comprises a resin and catalyst, to provide a relatively complete surface on a metal fender. There are spreaders for this purpose which have no handles at all and comprise only a relatively thin, flat blade made from plastic such as polyethylene or polypropylene and the like. The lack of a gripping surface or handle on such blades is at times a distinct disadvantage because sculpturing and contouring and control cannot be maintained and furthermore it is uncomfortable to grip such devices using only the outer portions of the fingers without any handle or gripping area that fits into the palm. Even the provision of an elongated, rigid permanent or detachable handle for holding such blades is not a solution to the problem because the rigidity of the handle interferes with the flexibility of the blade and vice versa and again control for sculpturing and contouring is not at its maximum. The present device provides a non-rigid but completely self-supporting handle which is made in a tubular form and may be squeezed, crushed, bent or otherwise deformed by means of the fingers and the hend.

SUMMARY OF THE INVENTION

A spreader comprising a substantially flat solid blade having a permanent handle attached thereto along one side thereof and said handle being tubular and hollow and thereby deformable to a limited amount.

The spreader mentioned in the previous paragraph wherein the blade and the handle are molded integrally and the handle is blow molded to provide the hollow space inside.

An object of the present invention is to provide a spreader of the sort mentioned in the preceding paragraphs whereby the handle may be gripped in the palm of the hand and manipulated by the fingers to assist in contouring and sculpturing and to aid in the control over the substance being spread.

Another object of this invention resides in the combination of a solid dense spreader blade and a deformable less tubular handle running along one edge thereof.

Other and futher objects and advantages of this invention will become apparent upon reading the description of the preferred embodiment with reference to the brief description of the drawings hereinafter.

BRIEF DESCRIPTION OF THE DRAWINGS

FIG. 5 is a perspective view of the device of FIG. 1 held in the hand in one position normally used for spreading, contouring, sculpturing and the like.

DESCRIPTION OF THE PREFERRED EMBODIMENT

Figure 1:
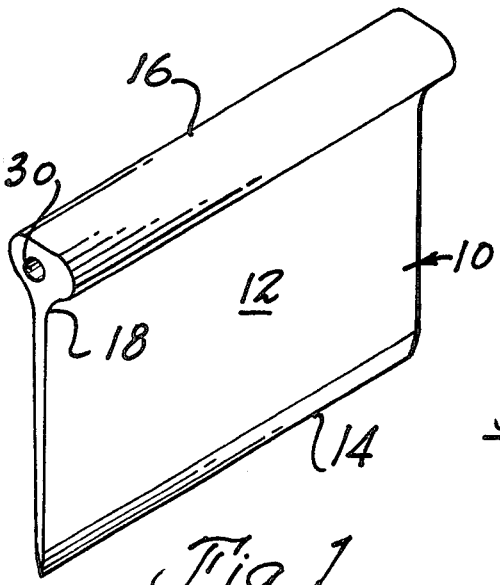
FIG. 1 is a perspective view of the present invention.
Figure 2:
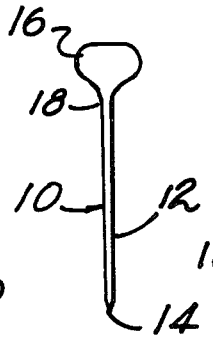
FIG. 2 is an end elevation view of the device shown in FIG. 1 looking at the opposite end from the end shown therein.
Figure 3:
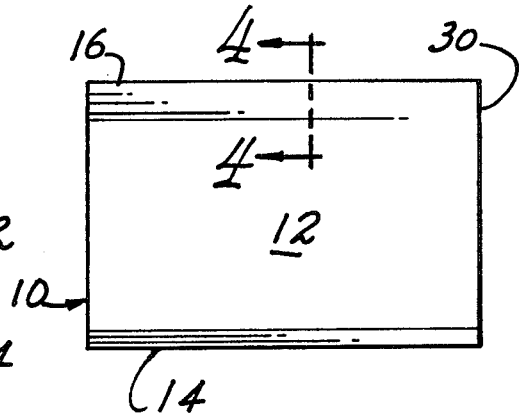
FIG. 3 is a side elevation view of one side of the device shown in FIG. 1.
Figure 4:
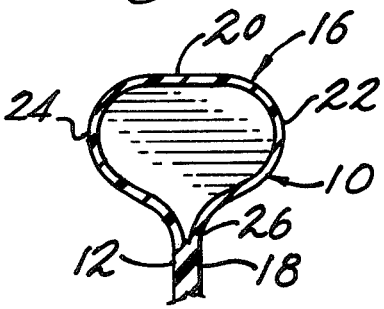
FIG. 4 is a cross-sectional view taken along lines 4—4 in FIG. 3.

The spreader designated generally by reference numeral 10 comprise a flat slightly tapered blade 12 which leads to a blade edge 14 and a deformable handle 16 leading from the opposite side of the blade 12 from the edge 14. Handle 16 is somewhat tubular in formation and is hollow inside as readily apparent in FIG. 4 comprising a thin top wall 20, curved side walls 22, 24 and a bottom edge 26 which is integral with the upper edge 18 of the blade 12. As readily seen in FIG. 4 the blade 12 in cross-section is solid all the way through the lower edge 14.

The device 10 may be manufactured in a plastic molding procedure comprising the steps of blow molding which is a common mold procedure and injection molding which is also a common mold procedure. Blow mold machines and injection molding machines have been on the market for many years and are commonly used for numerous products. Blow molding is one procedure for making plastic bottles and jugs of the sort which are used to contain milk, disinfectant, or many other chemiclas. On the other hand, injection molding is a common procedure for making solid plastic articles or parts from any number of plastics such as polyethylene of polypropylene mentioned previously. The handle 16 is blow molded on the injection molded blade 12 thereby producing the relatively thin walls and hollow interior clearly shown in FIG. 4, leaving a blow mold hole 30 in and end wall which is open to the atmosphere so that no air is trapped within handle 16 and it is easier to squeeze the handle in the manner shown in FIG. 5.

Figure 5:
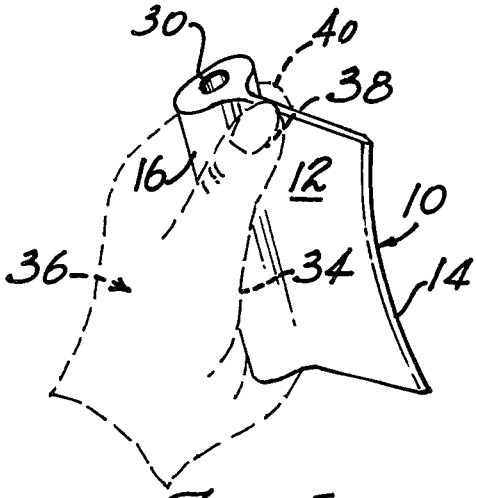
Figure 6:
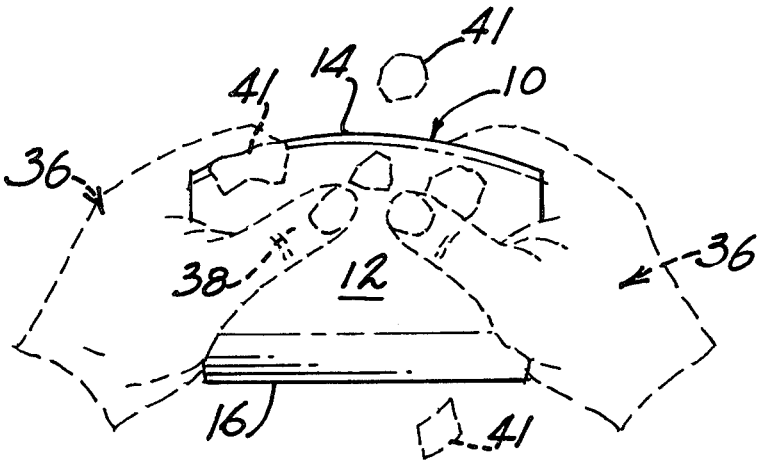
FIG. 6 is a diagrammatic view illustrating the cleaning of the device of FIG. 1 to remove dried particles therefrom.

In operation of the device shown in FIG. 5, the handle 16 which is sufficiently elongated to fit across and from opposite sides of the ordinary palm 34 of a hand 36 so that the thumb 38 rests on one side of the blade 12 and handle 16 and the other fingers 40 are wrapped around the handle 16 and may be squeezed and even deformed and crushed between the fingers 38, 40 and by means of the palm 34 to bend the handle 16 somewhat about the longitudinal centerline extending through the central portion of the tubular handle 16 and at the same time to curve the blade 12 which may be desirable and even necessary for the purpose of working fast-drying epoxy or other resin body solder so as to move it into cracks, crannies, and depressions in the metal or material being filled and to work it constantly until the smoothest exterior surface is accomplished but with a minimum of fatigue on the hand. In the process of working fast-drying plastic solder or other mastic material the material which is designated by reference numberal 41 in FIG. 6 dries and cakes upon blade 12 and must be removed. For this operation both of the hands 36 as shown in FIG. 6 are used to grasp the blade 12 and-or the handle 16 and to manipulate, bend, twist and warp or otherwise deform both the handle and the blade so as to crack the dried material 41 therefrom.

While I have shown and described a particular embodiment of this invention this is by way of illustration only and does not constitute any limitation on the scope of this invention since various alterations, changes, deviations, eliminations, ommissions, additions, changes and departures may be made in the embodiment shown without avoiding the scope of the invention as defined only by a proper interpretation of the appended claims.

What is claimed is:

1. In a spreader which may be manufactured from solid plastic or the like:

a bendable spreader blade of substantially flat solid and planar construction having a bottom edge thereon, an elongated top portion on said spreader spreader, an elongated tubular and deformable handle integrally attached to said blade along said top portion thin closed side walls and, and walls and a hollow interior whereby said handle may be the said walls being thinner than the blaedes, deformed by the hand by squeezing, twisting or otherwise manipulating same said blade being more ridig more dense and less flexible than said handle so that said solid blade may be maniplated and curved or deformed to a lesser extent than said handle thereby providing contouring, sculpturing and control over a liquid material which is being worked into a solid material.

2. The device claimed in claim 1 wherein said blade is molded from plastic and said handle is likewise molded from the same plastic material.

3. The device claimed in claim 1 wherein said handle has an opening.

4. The device claimed in claim 1 wherein said handle has a substantially top elongated flat portion and curved side walls curving from said top portion and joining integrally with the top portion of said blade.

5. The device claimed in claim 3 wherein said blade is molded from plastic and said handle is likewise molded from the same plastic material.

6. The device claimed in claim 4 wherein said handle has an opening in and end wall open to the atmosphere so that air is not trapped within the handle.

7. The device claimed in claim 2 wherein said handle has a substantially top elongated flat portion and curved side walls curving from said top portion and joined integrally with the top portion of said blade.

* * * * *